US012543878B1

(12) United States Patent
Millard

(10) Patent No.: US 12,543,878 B1
(45) Date of Patent: Feb. 10, 2026

(54) MAILBOX DELIVERY INDICATOR

(71) Applicant: Ronnie Millard, Eatonton, GA (US)

(72) Inventor: Ronnie Millard, Eatonton, GA (US)

( * ) Notice: Subject to any disclaimer, the term of this patent is extended or adjusted under 35 U.S.C. 154(b) by 0 days.

(21) Appl. No.: 18/650,336

(22) Filed: Apr. 30, 2024

(51) Int. Cl.
*A47G 29/12* (2006.01)

(52) U.S. Cl.
CPC .. *A47G 29/121* (2013.01); *A47G 2029/12105* (2017.08)

(58) Field of Classification Search
CPC ..... A47G 29/121; A47G 2029/12105; A47G 2029/1229
See application file for complete search history.

(56) References Cited

U.S. PATENT DOCUMENTS 1,973,020 A * 9/1934 Smith ..... A47G 29/121 232/35
2,573,879 A * 11/1951 Seibel ..... A47G 29/121 232/35
2,754,051 A * 7/1956 Shellabarger ..... A47G 29/1212 232/35
2,853,230 A * 9/1958 Hays ..... A47G 29/121 232/35
2,864,553 A * 12/1958 Petrie ..... A47G 29/121 232/35
2,954,920 A * 10/1960 Harger ..... A47G 29/121 232/35
3,026,024 A * 3/1962 Holmgren ..... A47G 29/121 232/35
3,026,025 A * 3/1962 Hanson ..... A47G 29/121 232/35
3,034,706 A * 5/1962 Wing ..... A47G 29/121 232/35
3,318,516 A * 5/1967 Scheerer ..... A47G 29/1212 232/35
3,606,141 A * 9/1971 Taylor ..... A47G 29/121 232/35
3,675,845 A * 7/1972 Scheerer ..... A47G 29/121 232/35
3,722,460 A * 3/1973 James, Sr. ..... A47G 29/121 232/35
4,150,780 A * 4/1979 Mapes ..... A47G 29/121 232/35
4,154,392 A * 5/1979 Galstad ..... A47G 29/121 232/35
4,205,778 A * 6/1980 File ..... A47G 29/121 232/35

(Continued)

FOREIGN PATENT DOCUMENTS

CA 2013992 7/1994

*Primary Examiner* — William L Miller

(57) ABSTRACT

The mailbox delivery indicator is a signaling device. The mailbox delivery indicator incorporates a mailbox structure, a mechanical linkage structure, and a reflector structure. The mechanical linkage structure and the reflector structure attach to the mailbox structure. The mailbox structure forms a protected space that receives and stores one or more traditional messaging facilities. The mechanical linkage structure: a) mechanically detects when the protected space formed by the mailbox structure is accessed; and, b) mechanically changes the orientation of the reflector structure from a closed position into an open position. In the open position, the reflector structure presents a visible indication that the protected space of the mailbox structure has been accessed.

10 Claims, 6 Drawing Sheets

(56) References Cited

U.S. PATENT DOCUMENTS

| | | | | | |
|---|---|---|---|---|---|
| 4,220,278 | A * | 9/1980 | Hasselbring | A47G 29/121 | 232/35 |
| 4,318,507 | A * | 3/1982 | Thopsey | A47G 29/121 | 232/35 |
| 4,473,182 | A | 9/1984 | Dion | | |
| 4,706,880 | A * | 11/1987 | Peters | A47G 29/121 | 232/35 |
| 4,877,180 | A * | 10/1989 | Shull | A47G 29/121 | 232/35 |
| 5,092,517 | A * | 3/1992 | Jeffries, Jr | A47G 29/121 | 232/35 |
| 5,201,465 | A * | 4/1993 | Limehouse | A47G 29/121 | 232/35 |
| 5,588,588 | A * | 12/1996 | Byrd | A47G 29/121 | 232/35 |
| 5,769,312 | A | 6/1998 | Lampe | | |
| 5,927,596 | A * | 7/1999 | Trenier | A47G 29/121 | 232/35 |
| D457,706 | S | 5/2002 | Teichelman | | |
| 7,014,097 | B1 * | 3/2006 | Gaillard | A47G 29/121 | 232/35 |
| 7,083,080 | B2 | 8/2006 | McKenzie | | |
| 7,337,945 | B1 * | 3/2008 | Riggs | A47G 29/121 | 232/35 |
| 7,559,456 | B1 | 7/2009 | McKenzie | | |
| 8,087,574 | B1 | 1/2012 | Harris | | |
| 9,565,961 | B1 | 2/2017 | Kirschner, Sr. | | |
| 10,750,893 | B2 | 8/2020 | Dean | | |
| 2002/0152949 | A1 * | 10/2002 | Turner | A47G 29/121 | 116/284 |
| 2019/0099029 | A1 * | 4/2019 | Dean | A47G 29/121 | |

* cited by examiner

MAILBOX DELIVERY INDICATOR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of signaling devices activated by an inlet door. (A47G2029/12105)

SUMMARY OF INVENTION

The mailbox delivery indicator is a signaling device. The mailbox delivery indicator comprises a mailbox structure, a mechanical linkage structure, and a reflector structure. The mechanical linkage structure and the reflector structure attach to the mailbox structure. The mailbox structure forms a protected space that receives and stores one or more traditional messaging facilities. The mechanical linkage structure: a) mechanically detects when the protected space formed by the mailbox structure is accessed; and, b) mechanically changes the orientation of the reflector structure from a closed position into an open position. In the open position, the reflector structure presents a visible indication that the protected space of the mailbox structure has been accessed.

These together with additional objects, features and advantages of the mailbox delivery indicator will be readily apparent to those of ordinary skill in the art upon reading the following detailed description of the presently preferred, but nonetheless illustrative, embodiments when taken in conjunction with the accompanying drawings.

In this respect, before explaining the current embodiments of the mailbox delivery indicator in detail, it is to be understood that the mailbox delivery indicator is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the mailbox delivery indicator.

It is therefore important that the claims be regarded as including such equivalent construction insofar as they do not depart from the spirit and scope of the mailbox delivery indicator. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
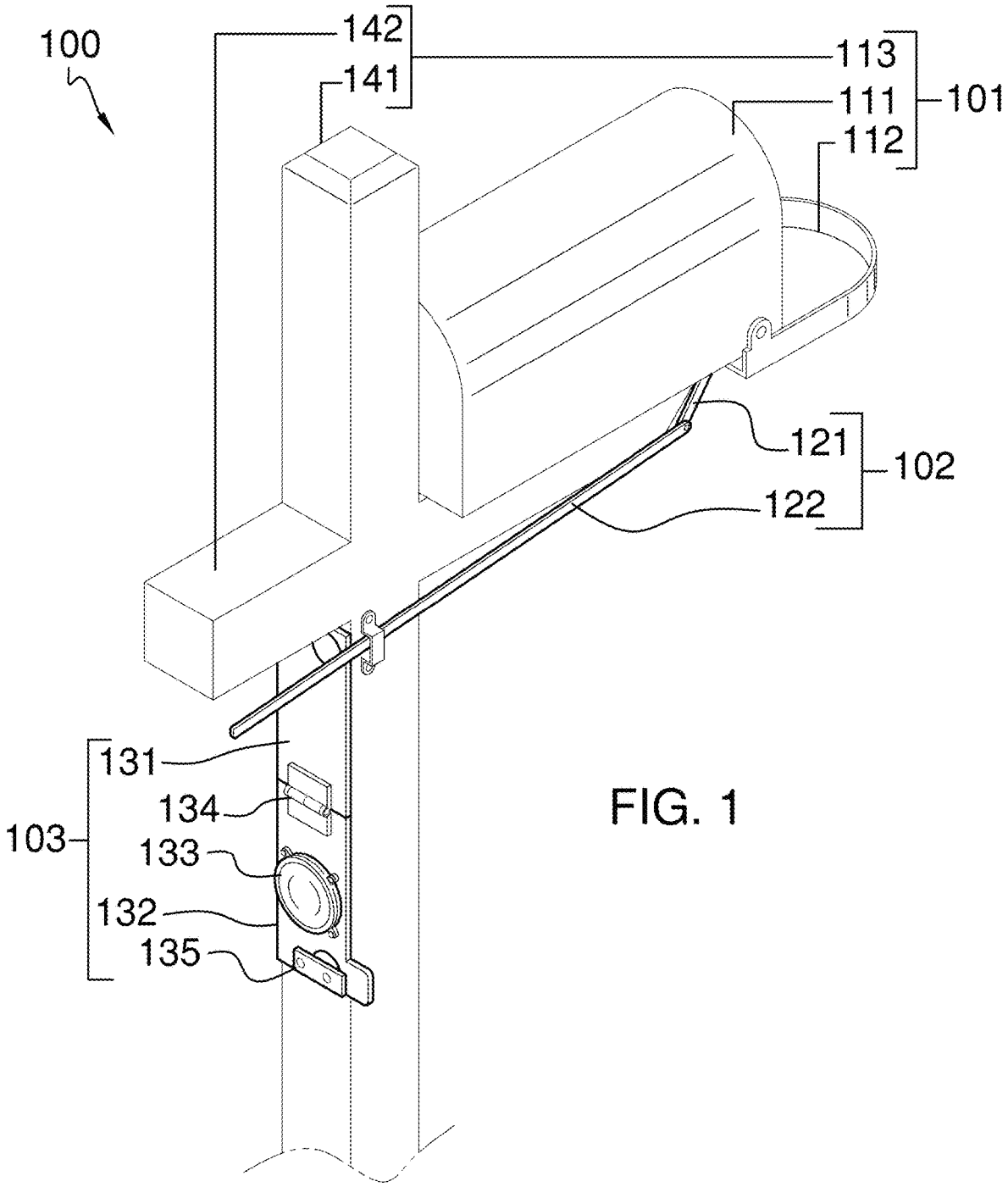
FIG. 1 is a perspective view of an embodiment of the disclosure.
Figure 2:
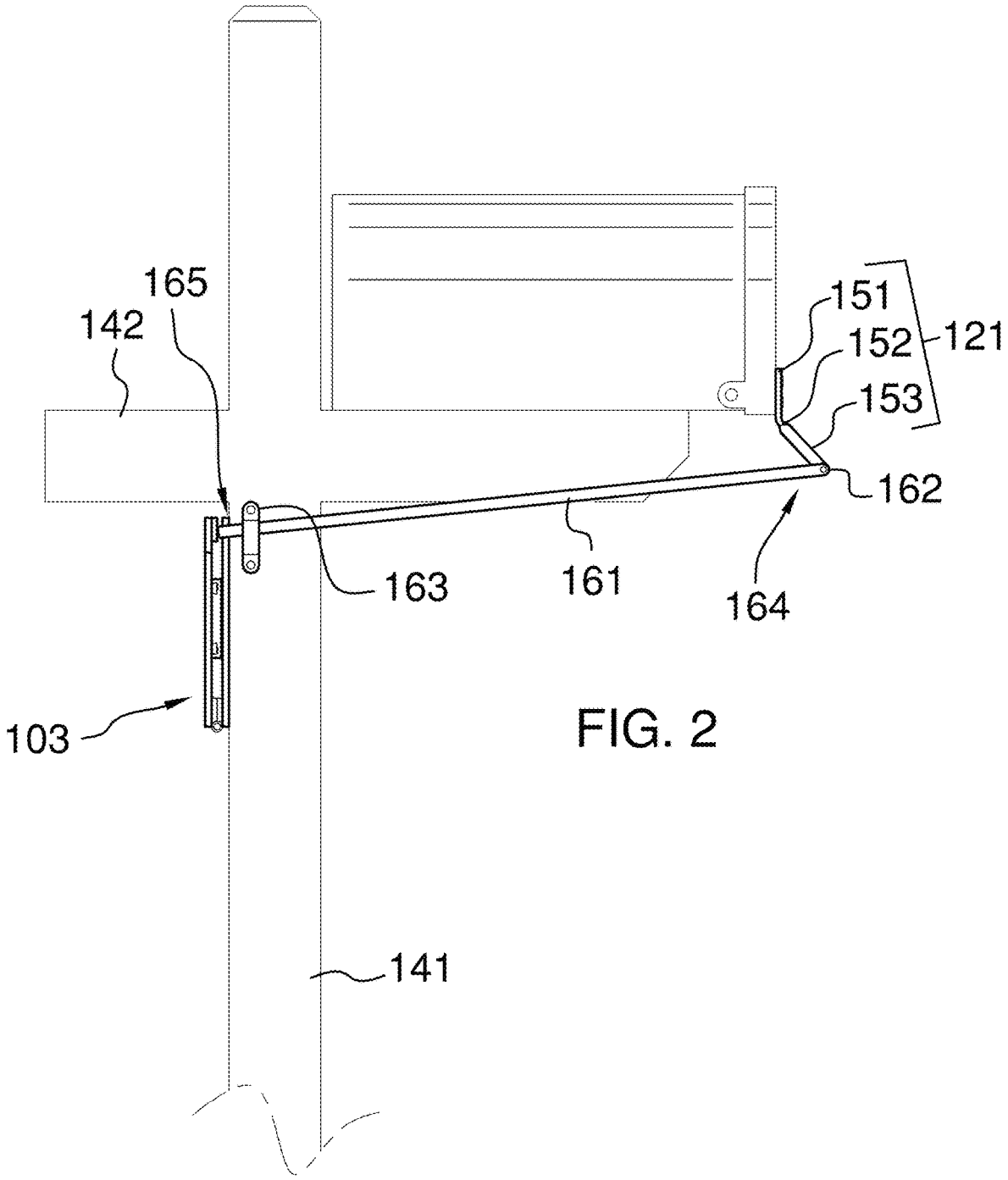
FIG. 2 is a side view of an embodiment of the disclosure.
Figure 3:
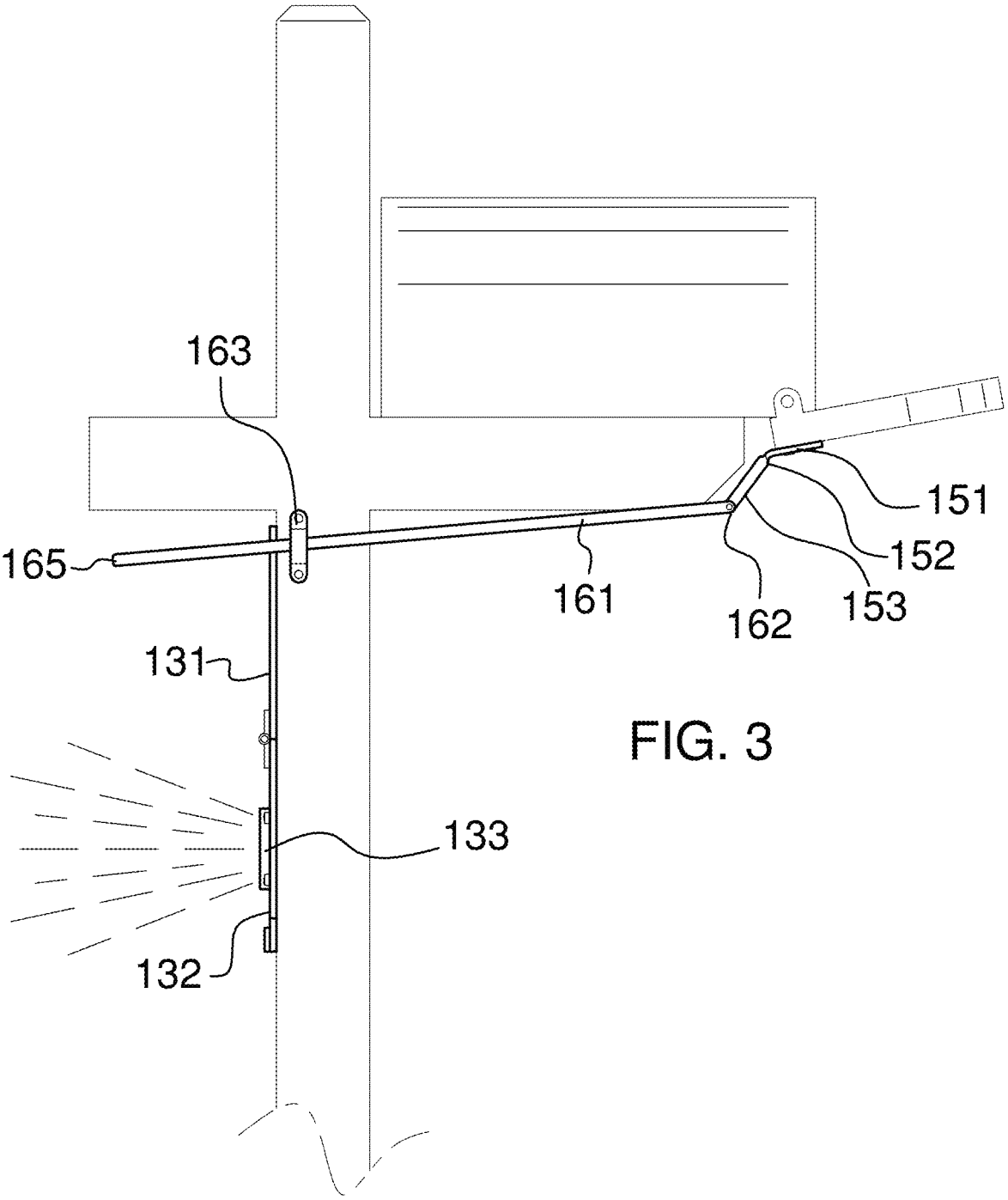
FIG. 3 is a side view of an embodiment of the disclosure.
Figure 4:
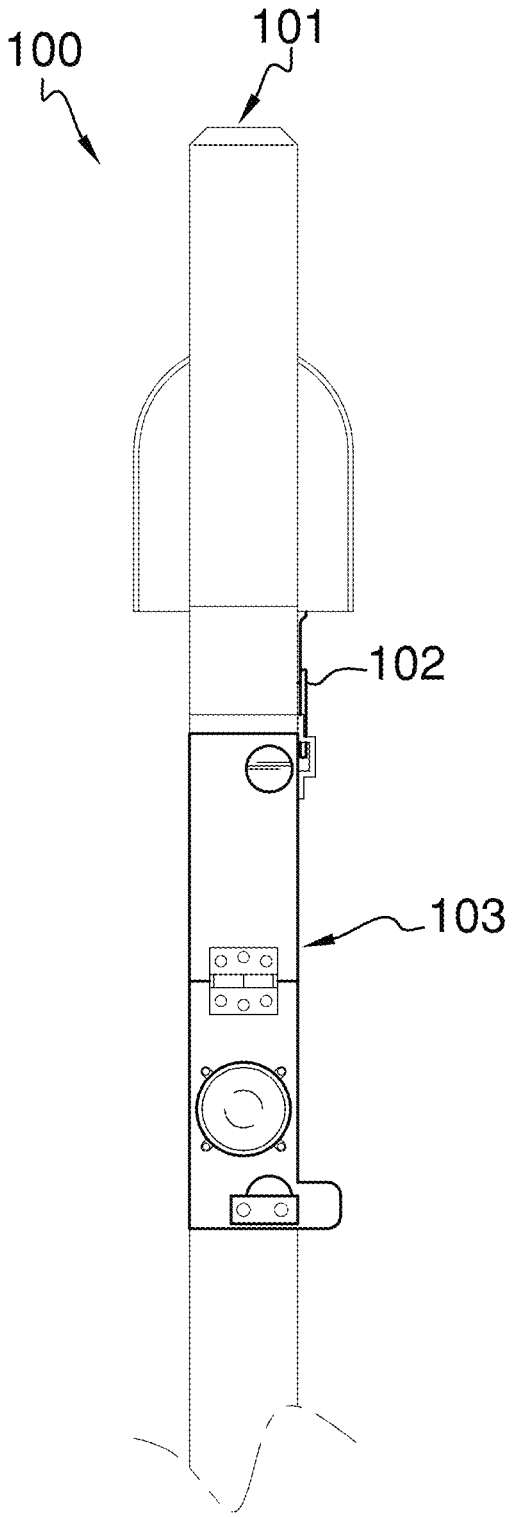
FIG. 4 is a rear view of an embodiment of the disclosure.
Figure 5:
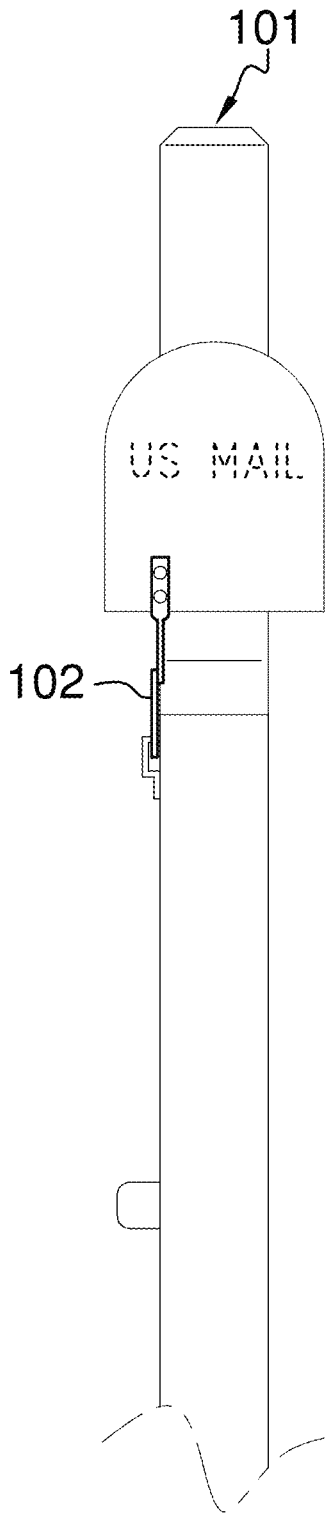
FIG. 5 is a front view of an embodiment of the disclosure.
Figure 6:
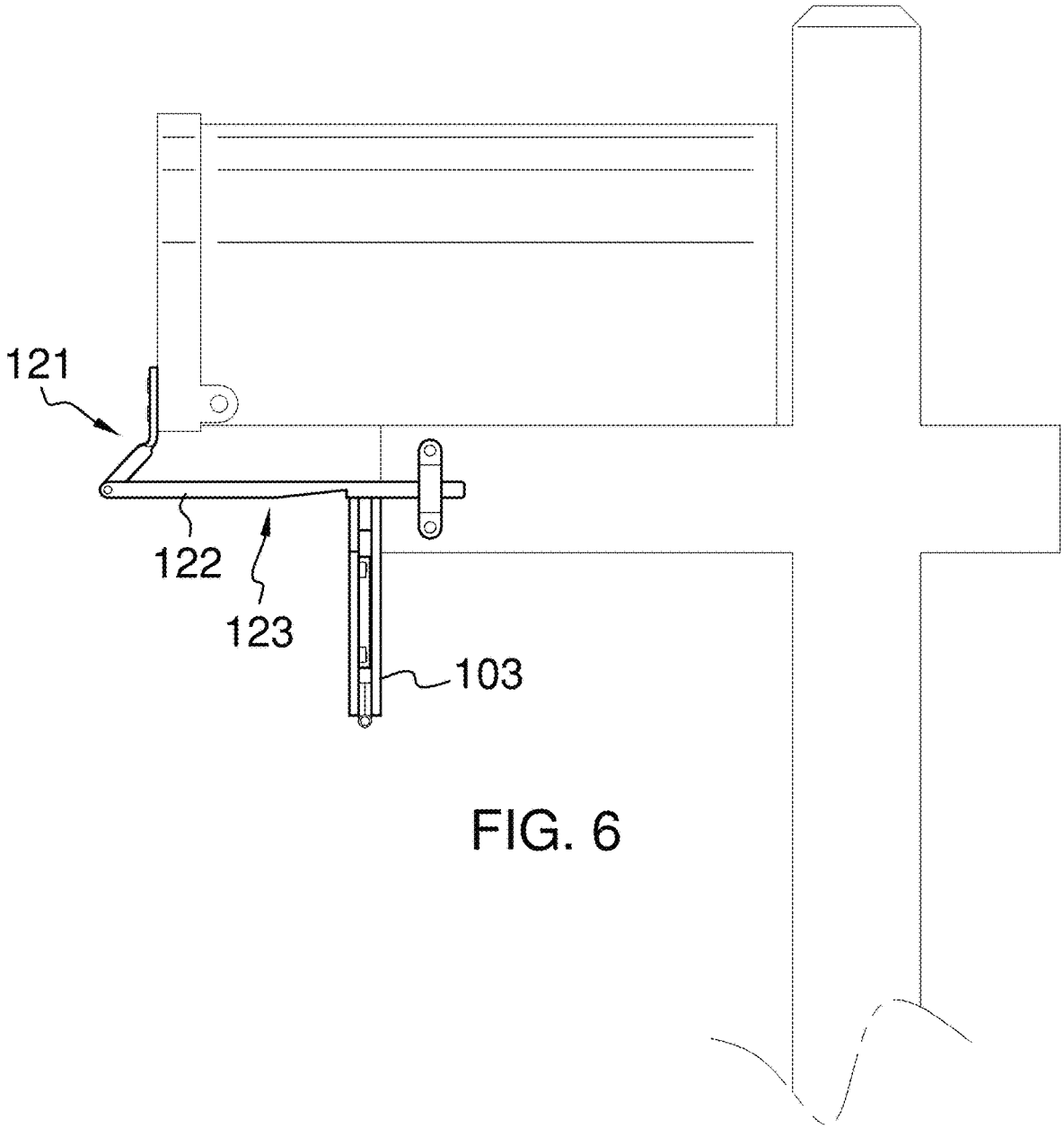
FIG. 6 is a side view of an alternate embodiment of the disclosure.
Figure 7:
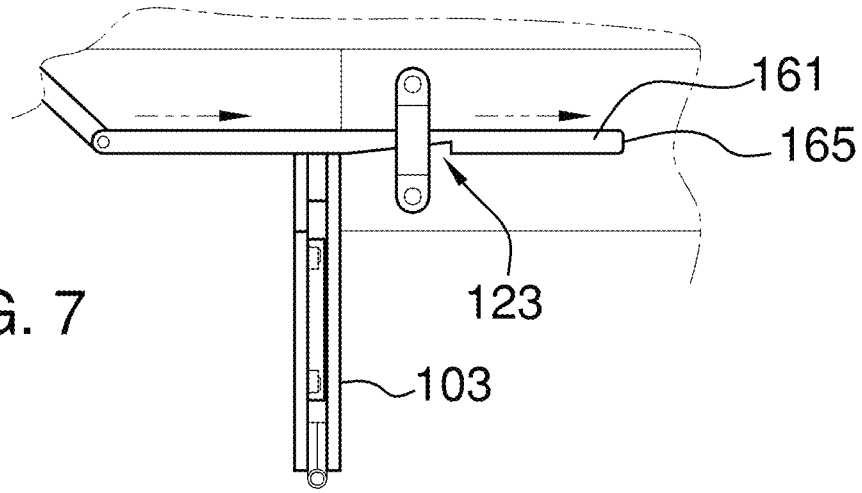
FIG. 7 is a detail view of an embodiment of the disclosure.
Figure 8:
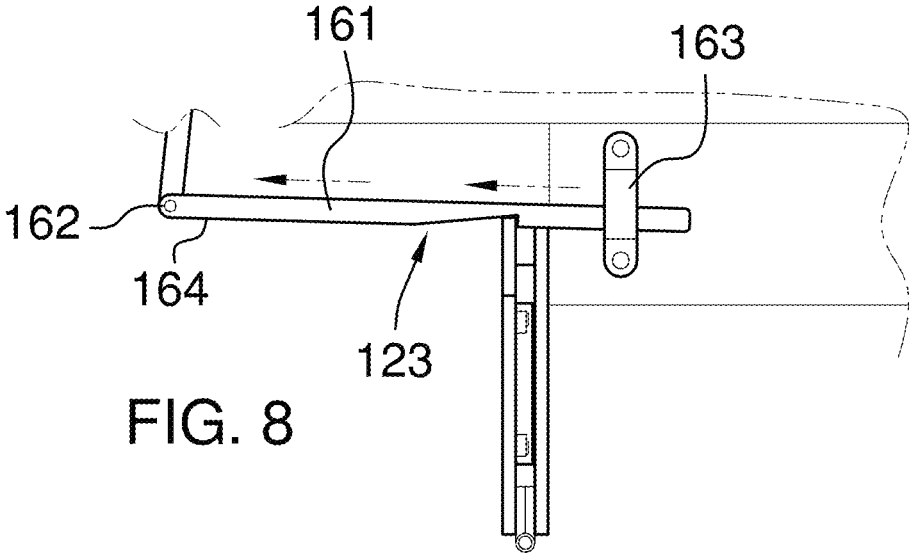
FIG. 8 is a detail view of an embodiment of the disclosure.
Figure 9:
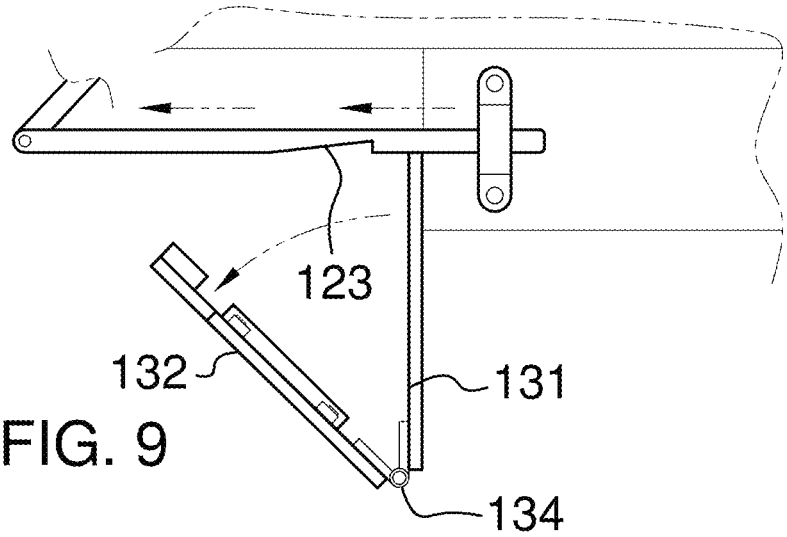
FIG. 9 is a detail view of an embodiment of the disclosure.

Detailed reference will now be made to one or more potential embodiments of the disclosure, which are illustrated in FIGS. 1 through 9.

The mailbox delivery indicator 100 (hereinafter invention) is a signaling device. The invention 100 comprises a mailbox structure 101, a mechanical linkage structure 102, and a reflector structure 103. The mechanical linkage structure 102 and the reflector structure 103 attach to the mailbox structure 101. The mailbox structure 101 forms a protected space that receives and stores one or more traditional messaging facilities. The mechanical linkage structure 102: a) mechanically detects when the protected space formed by the mailbox structure 101 is accessed; and, b) mechanically changes the orientation of the reflector structure 103 from a closed position into an open position. In the open position, the reflector structure 103 presents a visible indication that the protected space of the mailbox structure 101 has been accessed.

The mailbox structure 101 is a mechanical structure. The mailbox structure 101 is anchored into the ground. The mailbox structure 101 forms an elevated protected space that is configured to store traditional messaging facilities. The mailbox structure 101 comprises a pan structure 111, a door structure 112, and a pedestal structure 113.

The pan structure 111 is a pan shaped structure. The pan structure 111 forms the containment space of the protected space formed by the mailbox structure 101. The pan structure 111 is formed with an open face. The pan structure 111 receives the traditional messaging facilities from the environment through the open face. The open face of the pan structure 111 is vertically oriented. The pan structure 111 attaches to the pedestal structure 113 such that the pedestal structure 113 elevates the pan structure 111 above the ground.

The door structure 112 forms a lid that encloses the protected space formed by the pan structure 111. The door structure 112 is geometrically similar to the open face of the pan structure 111. The door structure 112 attaches to the pan structure 111 such that the door structure 112 rotates between a closed position and an open position. The door structure 112 encloses the protected space formed by the pan structure 111 in the closed position. The door structure 112 allows access into the protected space formed by the pan structure 111 in the open position. The mechanical linkage structure 102 attaches to the door structure 112 such that the rotation of the door structure 112 transfers to the mechanical linkage structure 102 the motive forces required for the operation of the mechanical linkage structure 102.

The pedestal structure 113 forms the structure that anchors the invention 100 to the ground. The pedestal structure 113 elevates the pan structure 111, the door structure 112, the mechanical linkage structure 102 and the reflector structure 103 above the ground. The pedestal structure 113 is a load bearing structure. The pedestal structure 113 forms the final link in the load path that transfers the load of the invention 100 to the ground. The pedestal structure 113 further comprises a stanchion structure 141 and a beam structure 142.

The stanchion structure 141 is a prism structure. The stanchion structure 141 is a rigid structure. The stanchion structure 141 is a load bearing structure. The stanchion structure 141 anchors the invention 100 to the ground. The stanchion structure 141 forms the final link in the load path that transfers the load of the invention 100 to the ground. The center axis of the stanchion structure 141 is vertically oriented.

The beam structure 142 is a prism structure. The beam structure 142 is a rigid structure. The beam structure 142 is a load bearing structure. The beam structure 142 attaches to the stanchion structure 141 such that the stanchion structure 141 elevates the beam structure 142. The center axis of the beam structure 142 is horizontally oriented. The pan structure 111 attaches to the superior lateral face of the beam structure 142. The pan structure 111 attaches to the beam structure 142 such that the pan structure 111 overhangs a congruent end of the beam structure 142. The overhang of the pan structure 111 allows the door structure 112 to freely rotate between the closed position and the open position.

The mechanical linkage structure 102 is a mechanical device. The mechanical linkage structure 102 forms a mechanical linkage between the door structure 112 of the mailbox structure 101 and the reflector structure 103. The operation of the mechanical linkage structure 102 initiates when the door structure 112 rotates into the open position such that the protected space is accessible to the environment. The initiation of the operation of the mechanical linkage structure 102 changes the orientation of the reflector structure 103 from an closed position to an open position such that a visible signal is displayed indicating the protected space has been accessed. The mechanical linkage structure 102 comprises a door linkage structure 121 and a transfer arm structure 122.

The door linkage structure 121 is the mechanical structure of the mechanical linkage structure 102 that attaches to the door structure 112 of the mailbox structure 101. The door linkage structure 121 is an energy transfer structure. The door linkage structure 121 is a rotating structure. The door linkage structure 121 forms a cam structure. The door linkage structure 121 draws rotational energy from the door structure 112 as the door structure 112 rotates from the closed position to the open position. The door linkage structure 121 converts the drawn rotational energy into a linear energy that is transferred directly to the transfer arm structure 122. The door linkage structure 121 further comprises a door plate 151, a hinge 152, and a arm 153.

The door plate 151 is a disk shaped structure. The door plate 151 is a rigid structure. The door plate 151 is a fastening device. The door plate 151 attaches the hinge 152 to the door structure 112 of the pan structure 111.

The hinge 152 is a mechanical structure. The hinge 152 is formed with a limited arc rotation. The hinge 152 attaches the arm 153 to the door plate 151 such that the cant between the arm 153 and the door plate 151 adjusts as the door structure 112 rotates relative to the pan structure 111.

The arm 153 is a prism structure. The arm 153 is a rigid structure. The arm 153 is a load bearing structure. The arm 153 forms the structure that transfers the energy generated by the rotation of the door structure 112 into the linear energy that is transferred to the transfer arm structure 122.

The transfer arm structure 122 is a rigid structure. The transfer arm structure 122 is a rotating structure. The transfer arm structure 122 attaches to the door linkage structure 121 in the manner of a cantilever. The transfer arm structure 122 forms a mechanical linkage between the door linkage structure 121 and the reflector structure 103. The transfer arm structure 122 receives the converted linear energy from the door linkage structure 121. The linear energy received from the transfer arm structure 122 pushes the transfer arm structure 122 into the reflector structure 103 such that the transfer arm structure 122 transfers the linear energy into the reflector structure 103. The linear energy transferred to the reflector structure 103 by the transfer arm structure 122 pushes the reflector structure 103 from the closed position to the open position. The transfer arm structure 122 further comprises a shaft 161, a pivot 162, and a guide 163.

The shaft 161 is a prism structure. The shaft 161 is a rigid structure. The shaft 161 is a load bearing structure. The shaft 161 attaches to the door linkage structure 121 in the manner of a cantilever. The shaft 161 forms an extension structure that bridges the reach between the door linkage structure 121 and the reflector structure 103. The shaft 161 transfers the linear energy received from the arm 153 of the door linkage structure 121 to the reflector structure 103 for use in rotating the reflector structure 103 to the open position. The shaft 161 further comprises a fixed congruent end 164 and a free congruent end 165. The fixed congruent end 164 is the congruent end of the shaft 161 that attaches to the arm 153 of the door linkage structure 121. The free congruent end 165 is the congruent end of the shaft 161 that interacts with the reflector structure 103.

The pivot 162 is a fastening device. The pivot 162 is a rotating device. The pivot 162 is formed with a limited arc rotation. The pivot 162 attaches the arm 153 to the fixed congruent end 164 of the shaft 161. The rotation of the pivot 162 allows the arm 153 to rotate relative to the shaft 161 while simultaneously aligning the transferred energy with the center axis of the pivot 162.

The guide 163 is a pipe clamp. The guide 163 secures the shaft 161 to the lateral face of the beam structure 142 of the pedestal structure 113. The guide 163 forms a mechanical support that guides the shaft 161 to the reflector structure 103.

In a second potential embodiment of the disclosure, the mechanical linkage structure 102 further comprises a catch notch 123. The catch notch 123 is a notch that is formed in the lateral face of the prism structure of the shaft 161 of the transfer arm structure 122. The catch notch 123 forms a hook that catches on the reflector structure 103 as the catch notch 123 passes the reflector structure 103 during the movement of the shaft 161 relatives to the reflector structure 103. The catch notch 123 applies a pulling force to the reflector structure 103 during the operation of the mechanical linkage structure 102. The use of the catch notch 123 allows for the reversal of the pushing force that is provided through the first potential embodiment of the disclosure. The catch notch 123 is intended for use in configurations of the invention 100 where a pulling force is more efficient for the operation of the reflector structure 103.

The reflector structure 103 forms a signal structure. The reflector structure 103 presents a visible signal to the environment indicating that the protected space of the mailbox structure 101 has been accessed. The reflector structure 103 is a rotating structure. The reflector structure 103 rotates between the closed position and the open position. The reflector structure 103 presents the visible signal to the environment when in the open position. The reflector structure 103 mechanically attaches to the mechanical linkage structure 102. The mechanical linkage structure 102 transfers the motive forces to the reflector structure 103 that are necessary to rotate the reflector structure 103 from the closed position to the open position. The reflector structure 103 mounts on the pedestal structure 113 of the mailbox structure 101. The reflector structure 103 comprises a fixed plate structure 131, a rotating plate structure 132, a reflector structure 133, an hinge 134, and a fastening device 135.

The fixed plate structure 131 is a disk shaped structure. The fixed plate structure 131 is a rigid structure. The fixed plate structure 131 forms the structure of the reflector structure 103 that permanently attaches the reflector structure 103 to the mailbox structure 101.

The rotating plate structure 132 is a disk shaped structure. The rotating plate structure 132 is a rigid structure. The rotating plate structure 132 is geometrically similar to the fixed plate structure 131. The hinge 134 is a rotating fastening device that attaches the rotating plate structure 132 to the fixed plate structure 131 such that the rotating plate structure 132 rotates relative to the fixed plate structure 131. The rotating plate structure 132 rotates between the closed position and the open position.

The rotating plate structure 132 comes in mechanical contact with the transfer arm structure 122 of the mechanical linkage structure 102 during the operation of the invention 100. The transfer arm structure 122 transfers the linear force received from the door linkage structure 121 directly to the rotating plate structure 132. The linear force applied to the rotating plate structure 132 rotates the rotating plate structure 132 from the closed position to the open position.

The reflector structure 133 is a reflector. The reflector is defined elsewhere in this disclosure. The reflector structure 133 mounts on a structure that is selected from the group consisting of: a) the interior congruent end of the disk structure of the fixed plate structure 131; and, b) the interior congruent end of the disk structure of the rotating plate structure 132. The interior congruent end of the disk structure of the fixed plate structure 131 is the congruent end of the fixed plate structure 131 that is proximal to the rotating plate structure 132. The interior congruent end of the disk structure of the rotating plate structure 132 is the congruent end of the rotating plate structure 132 that is proximal to the fixed plate structure 131. The reflections from the reflector structure 133 generates the visible signal that indicates that the protected space of the mailbox structure 101 has been accessed.

The fastening device 135 is a mechanical structure. The fastening device 135 detachably attaches the fixed plate structure 131 to the rotating plate structure 132 when the reflector structure 103 is in the rs closed position. The fastening device 135 is a magnetic device. The fastening device 135 mounts on a structure that is selected from the group consisting of: a) the interior congruent end of the disk structure of the fixed plate structure 131; and, b) the interior congruent end of the disk structure of the rotating plate structure 132.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Arc: As used in this disclosure, an arc refers to a portion of a circumference or a curved perimeter. When applied to an angle or cant, the arc also refers to a measure of an angular span as measured from a circle at the vertex formed by the sides of the angle.

Barrier: As used in this disclosure, a barrier is a physical obstacle that forms a boundary between a first space and a second space. The barrier prevents the passage of an object between the first space and the second space.

Beam: As used in this disclosure, a beam is a horizontally oriented load bearing structure.

Cam: As used in this disclosure, a cam is a mechanical device that converts: 1) a rotating motion into a linear motion; or, 2) a linear motion into a rotating motion.

Cant: As used in this disclosure, a cant is an angular deviation from one or more reference lines (or planes) such as a vertical line (or plane) or a horizontal line (or plane).

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Closed Position: As used in this disclosure, a closed position refers to a rotating structure that is in an orientation that prevents access to the contents of the structure. The closed position is often referred to as an object being "closed."

Composite Prism: As used in this disclosure, a composite prism refers to a structure that is formed from a plurality of structures selected from the group consisting of a prism structure, a pyramid structure, and a spherical structure. The plurality of selected structures may or may not be truncated or bifurcated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Container: As used in this disclosure, a container is a structure that forms a protected space (or protection space) used to store and transport an object. The term containment structure is a synonym for container. Use protected space or protection space.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Door: As used in this disclosure, a door is a movable, removable, or rotating barrier that controls access through an aperture into a protected or protection space.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Environment: As used in this disclosure, an environment refers to the physical conditions surrounding an object. The term environment is often limited to the physical conditions that the object interacts with.

Exterior: As used in this disclosure, the exterior is used as a relational term that implies that an object is not contained within the boundary of a structure or a space.

Fastening Device: As used in this disclosure, a fastening device is a device that is used to join or affix a first object to a second object.

Fixed and Free End: As used in this disclosure, a fixed end refers to the congruent end of a prism shaped structure that is secured to an anchor point of a primary structure. A free end refers to the congruent end of the prism shaped structure: a) that is distal from the fixed end; and, b) that is not secured to the primary structure. The free end of the prism shaped structure can be secured to a secondary structure that is independent of the primary structure. When the attaching structure is not prism shaped, the perimetrical boundary of the attaching structure is substituted for the prism shaped structure to identify the corresponding fixed and free ends.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. By the term essentially geometrically similar is meant that the primary shapes of two objects are geometrically similar except that there are functional items (such as fastening devices) associated with the primary shape may not maintain the ratio for geometric similarity. By the term roughly geometrically similar is meant that the form factors between the primary shape of the two objects can vary by a factor of up to 10% when the two objects are normalized to be roughly geometrically identical.

Ground: As used in this disclosure, the ground is a solid supporting surface formed by the Earth. The term level ground means that the supporting surface formed by the ground is roughly perpendicular to the force of gravity. The term underground refers to an object being underneath the superior surface of the ground.

Handle: As used in this disclosure, a handle is an object by which a tool, object, or door is held or manipulated with the hand.

Hinge: As used in this disclosure, a hinge is a device that permits the turning, rotating, or pivoting of a first object relative to a second object. A hinge designed to be fixed into a set position after rotation is called a locking hinge. A spring loaded hinge is a hinge formed as an elastic structure. The elastic structure of the spring loaded hinge is deformed under a rotating force such that the elastic structure returns the spring loaded hinge back to its relaxed shape after the rotating force is removed from the spring loaded hinge.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Lateral Prism Structure: As used in this disclosure, a lateral prism structure refers to the juxtaposition of a first lateral face of a first prism structure to a second lateral face of a second prism structure such that: a) the center axes of the first prism and the second prism are parallel; and, b) the congruent ends of the first prism are parallel to the congruent ends of the second prism. The span of the length of the center axes of the first prism and the second prism need not be equal. The form factor of the congruent ends of the first prism and the second prism need not be geometrically similar.

Ledge: As used in this disclosure, a ledge is a horizontal surface that projects away from a vertical structure. A ledge that projects away from, or overhangs, the vertical structure in the manner of a cantilever is referred to as an undercut ledge.

Lid: As used in this disclosure, a lid is a removable cover that is placed over an opening of a hollow structure to enclose the hollow structure.

Limited Arc Rotation: As used in this disclosure, a limited arc rotation refers the rotation of a structure that: a) has a rotation that allows the reversal of the direction of rotation of the structure; and, b) has an arc of rotation of less than 360 degrees.

Lip: As used in this disclosure, a lip refers to the region of the lateral face of a pan or tube structure that abuts the perimeter of the open face of the pan or tube structure. By abutting the perimeter of the open face is meant that the lip forms a brink with the surface that forms the perimeter of the open face. The lip of the interior surface of the pan structure is called the interior lip. The lip of the exterior surface of the pan structure is called the exterior lip. The region of the lateral face of a pan structure that abuts the perimeter of the closed face of the pan structure is called the brink lip.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Magnet: As used in this disclosure, a magnet is an ore, alloy, or other material that has its component atoms arranged so the material exhibits properties of magnetism such as: 1) attracting other iron-containing objects; 2) attracting other magnets; or, 3) or aligning itself in an external magnetic field. A magnet is further defined with a north pole and a south pole. By aligning with an external magnetic field is meant that the north-south pole structure of a first magnet will align with the north south pole of a second magnet. The pole of any first magnet will attract the opposite pole of any second magnet (i.e. a north pole will attract a south pole). A permanent magnet refers to an object that presents a magnetic field without requiring the presence of an electric current.

Mechanical Linkage: As used in this disclosure, a mechanical linkage is an interconnected arrangement of components that are used to manage the transfer of a movement or a force. A mechanical linkage is often referred to as a linkage.

Messaging Facility: As used in this disclosure, a messaging facility is a previously determined formatting structure through which a text or image (referred to in this definition as text) based communication is transmitted for delivery. A messaging facility is selected from the group consisting of a traditional messaging facility, a direct messaging facility and a broadcast messaging facility. A traditional messaging facility includes the delivery of a physical object containing the text based communication. The direct messaging facility includes communications that are addressed to a previously identified group of recipients. The broadcast messaging facility includes communications that are transmitted without the prior identification of the intended group of recipients. An example of a traditional messaging facility includes, but is not limited to, postal delivery. Examples of a direct messaging facilities include, but are not limited to, email, audio based communications, and SMS messages. A social media service is an example of a broadcast messaging facility.

Negative Space: As used in this disclosure, negative space is a method of defining an object through the use of open or empty space as the definition of the object itself, or, through the use of open or empty space to describe the boundaries of an object.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction. In a one to one correspondence, the first element of the first set is said to be associated to the second element of the second set to which the first element corresponds.

Open Position: As used in this disclosure, an open position refers to a rotating structure that is in an orientation that allows access to the contents of the structure. The open position is often referred to as an object being "open."

Orientation: As used in this disclosure, orientation refers to the positioning of a first object relative to: 1) a second object; or, 2) a fixed position, location, or direction.

Overhang: As used in this disclosure, an overhang is a term used in association with an object that is supported on an elevated supporting surface or platform. The overhang of an object refers to a portion of the object that extends beyond the boundary of the elevated supporting surface or platform such that a negative space exists beneath the overhung portion of the object.

Pan: As used in this disclosure, a pan is a hollow containment structure. The pan has a shape selected from the group consisting of: a) a prism; and, b) a truncated pyramid. The pan has a single open face. The open face of the pan is often, but not always, the superior face of the pan. The open face is a surface selected from the group consisting of: a) a congruent end of the prism structure that forms the pan; b) a lateral face of the prism structure that forms the pan, c) the base face of the truncated pyramid structure; and, d) the truncated face of the truncated pyramid structure. A semi-enclosed pan refers to a pan wherein the closed end of prism structure of the pan and/or a portion of the lateral face of the pan is also open.

Pedestal: As used in this disclosure, a pedestal is an intermediary load bearing structure that forms a load path between two objects or structures.

Perimeter: As used in this disclosure, a perimeter is one or more curved or straight lines that bounds an enclosed area on a plane or surface. The perimeter of a circle is commonly referred to as a circumference.

Pipe Clamp: As used in this disclosure, a pipe clamp is a strap like structure that is used to attach an object to a prism-shaped structure. The pipe clamp is a commercially available hardware item. A pipe clamp is commonly marketed as a conduit clamp and a pipe strap.

Pivot: As used in this disclosure, a pivot is a rod or shaft around which an object rotates or swings.

Primary Shape: As used in this disclosure, the primary shape refers to a description of the rough overall geometric shape of an object that is assembled from multiple components or surfaces. The term essential primary shape is used to indicate the exclusion of functional items that are attached to the structure of the primary shape.

Primary Structure: As used in this disclosure, a primary structure refers to the component of an object that the other components attach to. The primary structure is also called the base structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protected Space: As used in this disclosure, a protected space is a negative space within which an object is stored. The protected space is enclosed by a barrier structure that: a) prevents damage to the object contained within the protected space; b) maintains conditions that are appropriate for the object; c) protects the object within the protected space from potential dangers that are outside of the protected space; or, d) maintains the privacy of the object within the protected space.

Push and Pull: As used in this disclosure, the terms push and pull refer to the direction of a force that acts on an object relative to an identified location. The term push implies that the acting force increases the span of the distance between the object and the identified location. The term pull implies that the acting force decreases the span of the distance between the object and the identified location.

Reflection: As used in this disclosure, a reflection refers to the change of direction of a wave that occurs when the wave impacts a surface.

Reflector: As used in this disclosure, a reflector is a device that is used to change the direction of a wave. Reflectors can be used to focus the reflected wave towards a single point.

Rigid Structure: As used in this disclosure, a rigid structure is a solid structure formed from an inelastic material that resists changes in shape. A rigid structure will permanently deform as it fails under a force. See bimodal flexible structure.

Rotation: As used in this disclosure, rotation refers to the cyclic movement of an object around a fixed point or fixed axis. The verb of rotation is to rotate.

Roughly: As used in this disclosure, roughly refers to a comparison between two objects. Roughly means that the difference between one or more parameters of the two compared objects are not significantly different.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Stanchion: As used in this disclosure, a stanchion refers to a vertically oriented prism-shaped pole, post, or support.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

U-Shaped Structure: As used in this disclosure, a U-shaped structure is a type of offset composite prism structure. The U-shaped structure is a three sided structure comprising a crossbeam, a first arm, and a second arm. In a U-shaped structure, the first arm and the second arm project away from the crossbeam: 1) in the same direction; 2) at a roughly perpendicular angle to the crossbeam, and, 3) the span of length of the first arm roughly equals the span of length of the second arm. An illiterate U-shaped structure refers to a U-shaped structure wherein the span of the length of the first arm differs from the span of the length of the second arm by more than 10 percent. A guided U-shaped structure refers to a U-shaped structure that has: a) the first arc formed by the interior cant formed between the first arm and the crossbeam is greater than or equal to 100 degrees; b) a second arc formed by the interior cant formed between the second arm and the crossbeam is greater than or equal to 100 degrees; and, c) the first arc and the second arc are roughly equal.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Visible: As used in this disclosure, the term visible refers to the ability of an individual (referred to as a viewer) to see an object. The term visible implies that the direct "line of sight" between a viewer and the object does not have any opaque or semitransparent barriers between the viewer and the object that would inhibit the transmission of electromagnetic radiation between the viewer and the object. The term visibility is used to mean that an object is visible from the position of a viewer.

With respect to the above description, it is to be realized that the optimum dimensional relationship for the various components of the invention described above and in FIGS. 1 through 9 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A mailbox delivery indicator comprising a mailbox structure, a mechanical linkage structure, and a reflector structure; wherein the mailbox structure forms a protected space for receiving and storing mail; wherein the mechanical linkage structure and the reflector structure attach to the mailbox structure; wherein the reflector structure comprises a fixed plate structure, a rotating plate structure, a reflector, a hinge, and a fastening device; wherein the fixed plate structure is a disk shaped structure; wherein the fixed plate structure is a rigid structure; wherein the fixed plate structure attaches the reflector structure to the mailbox structure; wherein the rotating plate structure is a disk shaped structure; wherein the rotating plate structure is a rigid structure; wherein the rotating plate structure is geometrically similar to the fixed plate structure; wherein the hinge rotatably attaches the rotating plate structure to the fixed plate structure such that the rotating plate structure rotates relative to the fixed plate structure; wherein the rotating plate structure rotates between a closed position and an open position; wherein the mechanical linkage structure mechanically initiates operation when the protected space formed by the mailbox structure is accessed, and mechanically changes the orientation of the rotating plate structure from the closed position into the open position; wherein the rotating plate structure comes in mechanical contact with a transfer arm structure of the mechanical linkage structure during the operation of the mechanical linkage structure which mechanically changes the orientation of the rotating plate structure from the closed position to the open position; wherein the reflector mounts on one of the following: a) an interior congruent end of the disk structure of the fixed plate structure; and, b) an interior congruent end of the disk structure of the rotating plate structure; wherein the interior congruent end of the disk structure of the fixed plate structure is the congruent end of the fixed plate structure that is proximal to the rotating plate structure; wherein the interior congruent end of the disk structure of the rotating plate structure is the congruent end of the rotating plate structure that is proximal to the fixed plate structure; wherein reflections from the reflector generate a visible signal that indicates that the protected space of the mailbox structure has been accessed; wherein the fastening device detachably attaches the fixed plate structure to the rotating plate structure when the rotating plate structure is in the closed position; wherein the fastening device is a magnetic device; wherein the magnetic device mounts on one of the following: a) the interior congruent end of the disk structure of the fixed plate structure; and, b) the interior congruent end of the disk structure of the rotating plate structure.

2. The mailbox delivery indicator according to claim 1 wherein the mailbox structure includes a pedestal structure configured to be anchored into the ground; wherein the protected space of the mailbox structure is elevated above the ground.

3. The mailbox delivery indicator according to claim 2 wherein the mechanical linkage structure forms a mechanical linkage between a door structure of the mailbox structure and the reflector structure; wherein the operation of the mechanical linkage structure initiates when the door structure rotates into an open position such that the protected space is accessible; wherein the initiation of the operation of the mechanical linkage structure changes the orientation of the rotating plate structure from the closed position to the open position via contact between the transfer arm structure and the rotating plate structure such that the visible signal of the reflector is displayed indicating the protected space has been accessed.

4. The mailbox delivery indicator according to claim 3 wherein the reflector structure mounts on the pedestal structure of the mailbox structure.

5. The mailbox delivery indicator according to claim 4 wherein the mailbox structure comprises a pan structure, the door structure, and the pedestal structure; wherein the pan structure is a pan shaped structure; wherein the pan structure forms a containment space of the protected space formed by the mailbox structure; wherein the pan structure is formed with an open face; wherein the pan structure receives the mail through the open face; wherein the open face of the pan structure is vertically oriented; wherein the pan structure attaches to the pedestal structure such that the pedestal structure elevates the pan structure above the ground; wherein the door structure forms a lid that encloses the protected space formed by the pan structure; wherein the door structure is geometrically similar to the open face of the pan structure; wherein the door structure attaches to the pan structure such that the door structure rotates between a closed position and the open position; wherein the door structure encloses the protected space formed by the pan structure in the closed position; wherein the door structure allows access into the protected space formed by the pan structure in the open position; wherein the mechanical linkage structure attaches to the door structure such that the rotation of the door structure transfers to the mechanical linkage structure the motive forces required for the operation of the mechanical linkage structure; wherein the pedestal structure elevates the pan structure, the door structure, the mechanical linkage structure and the reflector structure above the ground; wherein the pedestal structure is a load bearing structure; wherein the pedestal structure transfers the load of the mailbox delivery indicator to the ground.

6. The mailbox delivery indicator according to claim 5
wherein the mechanical linkage structure comprises a door linkage structure and the transfer arm structure;
wherein the transfer arm structure attaches to the door linkage structure.

7. The mailbox delivery indicator according to claim 6
wherein the door linkage structure attaches to the door structure of the mailbox structure;
wherein the door linkage structure is an energy transfer structure;
wherein the door linkage structure is a rotating structure;
wherein the door linkage structure forms a cam structure;
wherein the door linkage structure draws rotational energy from the door structure as the door structure rotates from the closed position to the open position;
wherein the door linkage structure converts the drawn rotational energy into a linear energy that is transferred directly to the transfer arm structure.

8. The mailbox delivery indicator according to claim 7
wherein the door linkage structure further comprises a door plate, a hinge, and a arm;
wherein the door plate is a disk shaped structure;
wherein the door plate is a rigid structure;
wherein the door plate is a fastening device;
wherein the door plate attaches the hinge to the door structure of the pan structure;
wherein the hinge is formed with a limited arc rotation;
wherein the hinge attaches the arm to the door plate such that the cant between the arm and the door plate adjusts as the door structure rotates relative to the pan structure;
wherein the arm is a rigid structure;
wherein the arm is a load bearing structure;
wherein the arm forms the structure that transfers the energy generated by the rotation of the door structure into the linear energy that is transferred to the transfer arm structure.

9. The mailbox delivery indicator according to claim 8
wherein the transfer arm structure further comprises a shaft, a pivot, and a guide;
wherein the shaft is a rigid structure;
wherein the shaft is a load bearing structure;
wherein the shaft attaches to the door linkage structure in the manner of a cantilever;
wherein the shaft forms an extension structure that bridges the reach between the door linkage structure and the reflector structure;
wherein the shaft transfers the linear energy received from the arm of the door linkage structure to the reflector structure for use in rotating the reflector structure to the rs open position;
wherein the shaft further comprises a fixed ta congruent end and a free ta congruent end;
wherein the fixed ta congruent end is the congruent end of the shaft that attaches to the arm of the door linkage structure;
wherein the free congruent end is the congruent end of the shaft that interacts with the reflector structure;
wherein the pivot is a fastening device;
wherein the pivot is a rotating device;
wherein the pivot is formed with a limited arc rotation;
wherein the pivot attaches the arm to the fixed congruent end of the shaft;
wherein the rotation of the pivot allows the arm to rotate relative to the shaft while simultaneously aligning the transferred energy with the center axis of the pivot;
wherein the guide is a pipe clamp;
wherein the guide secures the shaft to the pedestal structure;
wherein the guide forms a mechanical support that guides the shaft to the reflector structure.

10. The mailbox delivery indicator according to claim 9
wherein the mechanical linkage structure further comprises a catch notch;
wherein the catch notch is a notch that is formed in the lateral face of the shaft of the transfer arm structure;
wherein the catch notch forms a hook that catches on the reflector structure as the catch notch passes the reflector structure during the movement of the shaft relatives to the reflector structure;
wherein the catch notch applies a pulling force to the reflector structure during the operation of the mechanical linkage structure.

* * * * *